United States Patent [19]

Miller

[11] Patent Number: 4,505,531

[45] Date of Patent: Mar. 19, 1985

[54] SOCKET TERMINAL AND CONNECTOR

[76] Inventor: Edwin A. Miller, 11 Old Elm Rd., Fairfield, Conn. 06432

[21] Appl. No.: 527,109

[22] Filed: Aug. 29, 1983

[51] Int. Cl.[3] ..... H01R 21/28; H01R 11/22

[52] U.S. Cl. ..... 339/64 R; 339/17 C; 339/221 M; 339/258 P; 339/262 R

[58] Field of Search ..... 339/17 C, 17 R, 220 R, 339/221 R, 221 M, 258 R, 258 P, 252 R, 256 R, 262 R, 276 A, 276 SF, 27 SB, 64 R, 64 M

[56] References Cited

U.S. PATENT DOCUMENTS

| | | | |
|---|---|---|---|
| 2,922,978 | 1/1960 | Engel | 339/17 R |
| 2,969,517 | 1/1961 | Gluck | 339/258 R X |
| 3,097,032 | 7/1963 | Hochheiser | 339/64 R X |
| 3,680,038 | 7/1972 | Johnson | 339/176 MP X |
| 3,681,744 | 8/1972 | Olsson | 339/17 C X |
| 3,803,537 | 4/1974 | Cobaugh et al. | 339/256 R |
| 3,865,455 | 2/1975 | Berg et al. | 339/17 C |
| 3,899,232 | 8/1975 | Berg et al. | 339/17 C |
| 4,012,107 | 3/1977 | Cobaugh et al. | 339/258 P |
| 4,193,660 | 3/1980 | Joconette | 339/258 R X |

FOREIGN PATENT DOCUMENTS

| | | | |
|---|---|---|---|
| 32537 | 7/1981 | European Pat. Off. | 339/17 C |

*Primary Examiner*—John McQuade
*Assistant Examiner*—Steven C. Bishop
*Attorney, Agent, or Firm*—Frank J. Thompson

[57] ABSTRACT

An improved socket terminal is described having a housing member and a terminal member positioned within the housing. The terminal member establishes a deflectable constriction within the housing. A pivot means is provided for enhancing the gripping force established between the housing, the terminal member and a plug terminal body which is inserted into the constriction. Various embodiments are disclosed for establishing the constriction. An improved method is also described for fabricating the terminal member.

27 Claims, 21 Drawing Figures

Fig. 2.
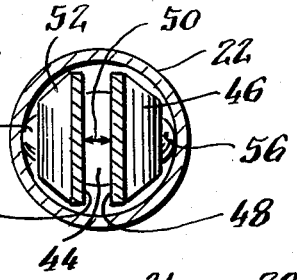
Fig. 3.
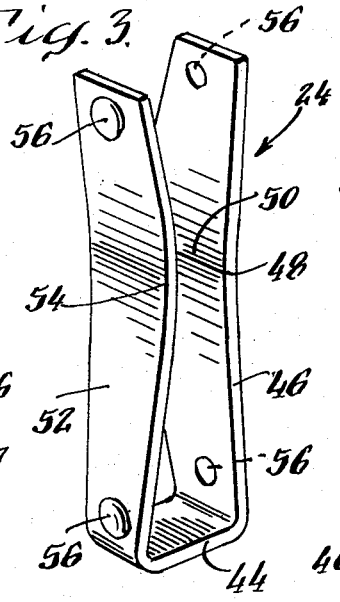
Fig. 4.
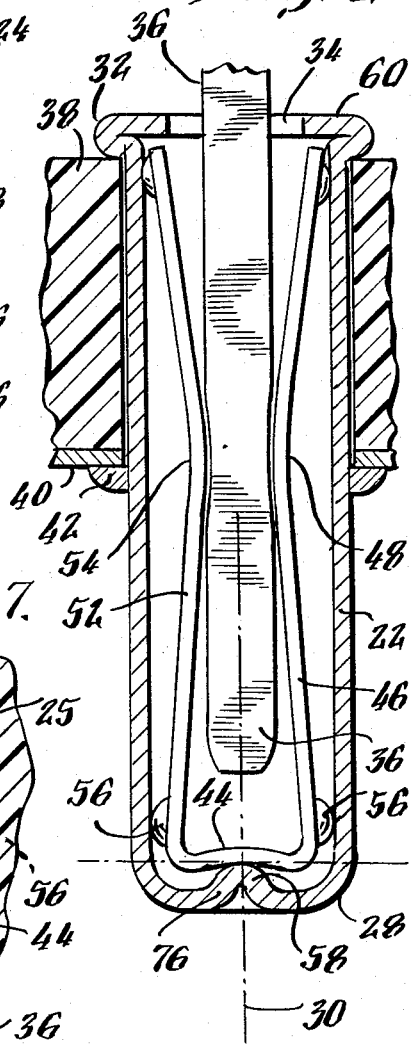
Fig. 1.
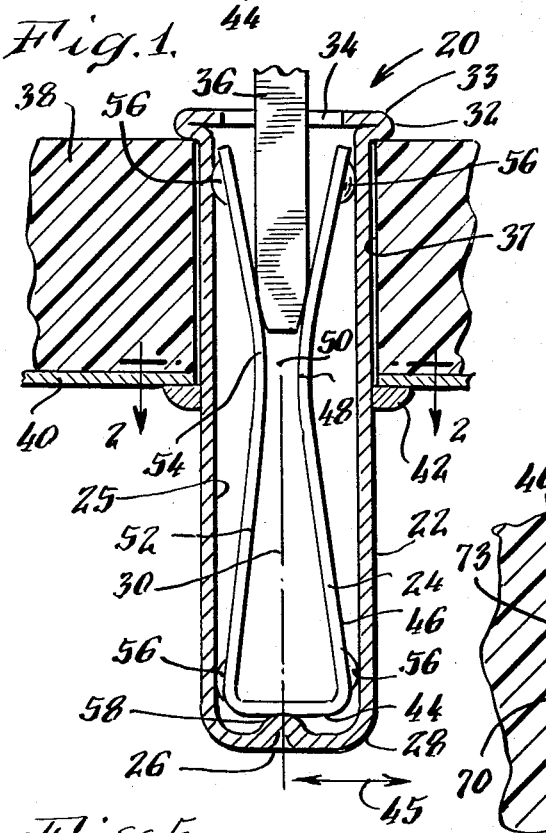
Fig. 7.
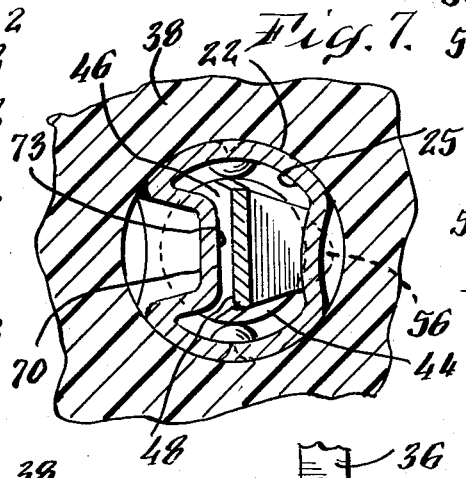
Fig. 5.
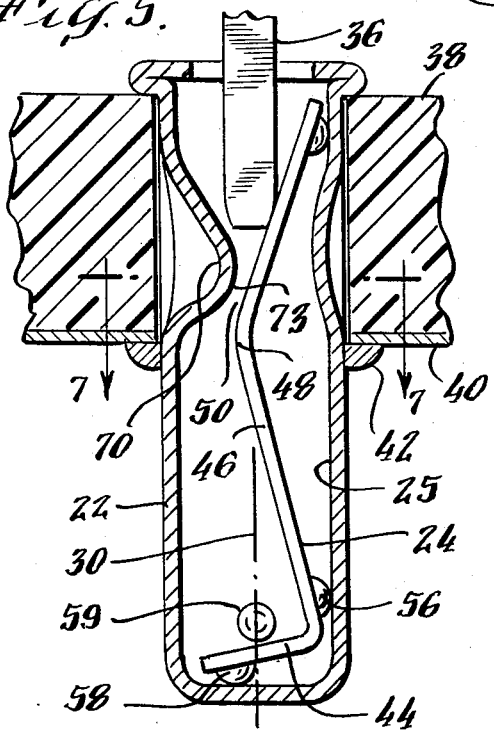
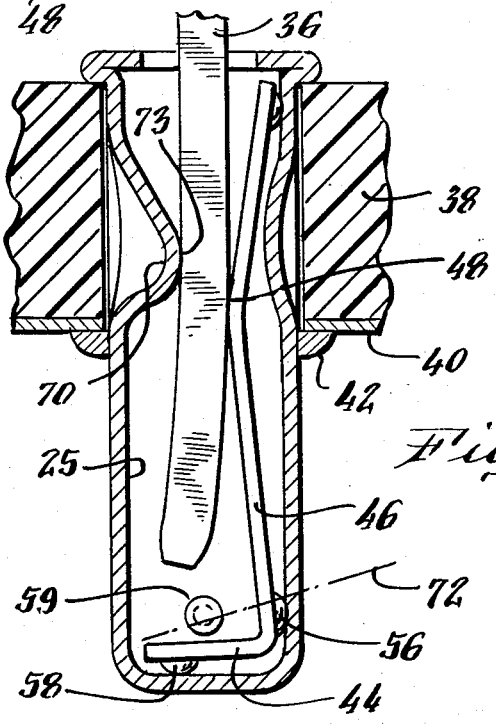
Fig. 6.

SOCKET TERMINAL AND CONNECTOR

BACKGROUND OF THE INVENTION

1. Field of the Invention

This invention relates to electrical terminals and connectors and to a method of fabricating the same. The invention relates more particularly to an improved form of socket terminal and connector formed therefrom and method for fabricating the terminal.

2. Description of the Prior Art

Present day electronic technology utilizes various small components such as microelectronic packages, integrated circuit components and transistors. These components include subminiature plug type (i.e. male) terminals of both rectangular and circular cross-sectional configuration for mounting and establishing electrical connection with a circuit board or a connector. The complexity and relatively small size of these components results in a dense assembly of closely spaced plug terminals which are to be electrically coupled to a receiving circuit board or connector. Generally, a plurality of socket terminals or a connector having a plurality of socket (i.e., female) terminals is provided which is mounted to and is electrically coupled to a printed circuit board for receiving the component. The electrical component plug terminals are then inserted in the socket terminals. It is of course desirable that the socket terminals reliably grip and establish electrical continuity with the plug terminals.

The plug terminal arrangements present several limitations in view of their size. The relatively small size of the components and the dense assembly of plug terminals renders it substantially difficult to simultaneously insert the numerous plug terminals into the sockets. This is particularly true when the plug terminal is rectangular shaped and alignment must be established between each pin and its receiving socket terminal. When a connector is part of a cable or patch cord or the like, the plugs and sockets are subjected to repeated connection and disconnection, which works the resilient metal terminal member and reduces the reliability of electrical continuity. Moreover, the relatively small size of these microcomponent socket terminals renders it difficult to fabricate and assembly the same.

SUMMARY OF THE INVENTION

Accordingly, it is an object of this invention to provide an improved socket terminal.

Another object of the invention is to provide an improved connector having a plurality of socket terminals for receiving and engaging micro-circuit plug terminals.

Another object of the invention is to provide a socket terminal assembly having an improved means for retaining a plug terminal positioned therein.

Another object of the invention is to provide an improved arrangement for enhancing the grip of a plug terminal by a socket terminal.

Another object of the invention is to provide a socket terminal assembly having a terminal member adapted to automatically align with a rectangular plug terminal Another object of the invention is to provide a socket assembly having a terminal member which is adapted to automatically engage both rectangular and circular pins.

A further object of the invention is to provide an improved socket terminal assembly for micro-circuit usages which can be economically fabricated.

Still another object of the invention is to provide an improved method for fabricating a socket terminal assembly.

In accordance with features of the present invention, an improved socket terminal assembly comprises a housing member and a terminal member. The housing member is formed of a generally annular-shaped body of material and has a longitudinal axis. In a preferred embodiment, the body is cylindrically shaped and is formed of an electrically conductive material. It is closed at one end and has a aperture at an opposite end for entrance of a plug terminal body therein. The terminal member is positioned in the housing member and is adapted to engage a plug terminal body upon entry of the plug body into the housing member and to establish electrical contact between the plug body and the housing member. The terminal member is formed of an electrically conductive, resilient metal having first and second segments. The first segment extends in a direction generally transverse to the longitudinal axis of the housing and the second segment, which has a generally bow-shaped configuration, extends both in the direction of the longitudinal axis and in a direction transverse to the axis. The second segment establishes within the housing member a deflectable constriction through which the plug body extends. Upon entry, the plug body initially engages the constriction and deflects the second terminal segment into engagement with the inner wall of the housing. The terminal member, in the absence of the plug body, is rotably unrestrained and is free to rotate about the axis in the housing body and is thus self-orienting for engaging a rectangular shaped plug body. Upon entry of the plug body, the terminal member is restrained against rotation.

Mechanical contact between the plug body and the second terminal segment is enhanced by means which provide a pivoting engagement between the first body segment and the housing member. The pivoting engagement enables deflection of a lower part of the second segment thus increasing the resilient engaging force between the second segment, the plug body, and the housing member.

In a preferred arrangement, the terminal member includes a third longitudinally extending segment which is also generally bow shaped and extends in longitudinal and transverse directions with respect to the housing member axis. A plug body gripping constriction is established between the second and third segments. A pivoting engagement is established between the first segment in the housing body member and the housing body by a body spaced therebetween and centrally located along the longitudinal axis. In a preferred arrangement, the pivot body is integrally formed with a lower segment of the housing body.

An improved method is also provided wherein the terminal member is fabricated by flattening wire to provide an elongated strip, widening segments of the flattened strip to provide terminal segments, forming dimples therein, forming the flattened strip to provide orientated segments of the terminal member, heat treating the formed strip and plating the terminal strip. The strip is then wound into a roll and introduced into a housing member from the roll. The roll is cut to position a severed member in the housing. In one embodiment, the housing body is deformed to provide a constriction segment and to provide restraining dimples.

BRIEF DESCRIPTION OF THE DRAWINGS

These and other objects and features of the invention will become apparent with reference to the following specification and to the drawings wherein:

FIG. 1 is an enlarged cross-sectional view of a socket terminal fabricated in accordance with a preferred embodiment of this invention and illustrating partial entry of a plug terminal body;

FIG. 2 is a view taken along line 2—2 of FIG. 1;

FIG. 3 is an enlarged, perspective view of a terminal member used with the socket terminal of FIG. 1;

FIG. 4 is an enlarged fragmentary view of the socket terminal of FIG. 1 illustrating a plug terminal body fully introduced into the socket terminal;

FIG. 5 is an enlarged, cross-sectional view of a socket terminal of the invention illustrating an alternative embodiment;

FIG. 6 is a view of the socket terminal of FIG. 5 and illustrating a plug terminal body fully introduced into the socket terminal;

FIG. 7 is a view taken along line 7—7 of FIG. 5;

DETAILED DESCRIPTION

Figure 8:
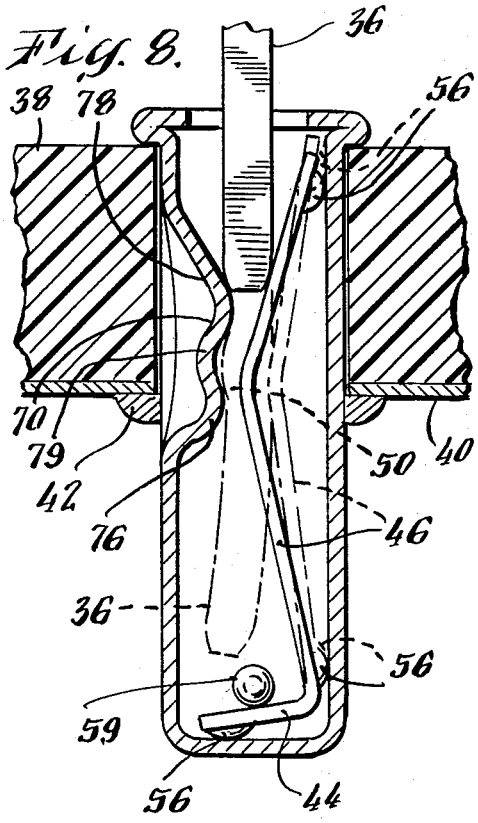
FIG. 8 is an enlarged cross-sectional view of a socket terminal of the invention and illustrating another alternative embodiment thereof.

Referring now to the drawings, there is illustrated in FIG. 1 a socket terminal referred to generally by reference numeral 20. The socket erminal 20 comprises a housing member 22 and a terminal member 24 which is positioned within the housing member 22. The socket terminal 20 is utilized for micro-circuit applications and is enlarged substantially in the drawings for clarity in discussion. Typically, the housing member 22 of the socket terminal 20 illustrated in FIG. 1 has a wall thickness of about 0.005 inches, an outside diameter of about 0.050 inches and a length of about 0.188 inches.

The housing member 22 comprises a generally annular shaped body having a longitudinal axis 30. In the preferred embodiment, it comprises a cylindrically shaped, electrically-conductive body which is formed, for example, of copper and is nickel and gold plated to enhance its electrical conductivity. The body 22 includes an inner wall surface 25 and a lower closure segment 26 which forms a closure at a first end 28 of the member. At a second opposite end 32, there is formed in a flange 33 of the member 22 an aperture 34 which provides access to the interior of the housing member 22 for entry of a plug terminal body 36. Plug terminal body 36 may be of circular or of other cross-sectional configuration such as square, rectangular, etc. Member 22 is illustrated in FIG. 1 as being positioned and supported in an aperture 37 of a printed circuit board 38. The printed circuit board is fabricated of an insulating material and includes an electrically conductive strip 40 which, in the preferred embodiment, is electrically coupled to the housing member 22 by soldering as is illustrated by the solder segment 42. Member 22 is preferably fitted into the aperture 37 and longitudinal movement is restricted by the flange 33.

The terminal member 24 is formed of a body of electrically conductive, resilient material. One such material comprises goldplated beryllium copper. Terminal member 24 includes a first segment 44 which extends in a direction 45 transverse to the longitudinal axis 30. Terminal member 24 further includes a second segment 46 which has a bow-shaped configuration extending in the direction of the axis 30 and in the direction 45 transverse to the axis 30. The bow-shaped configuration extends in the transverse direction 45 to a maximum point at a crest 48 and establishes a deflectable construction 50. The first and second segments 44 and 46, respectively, are integrally formed. The terminal member 24 further includes a third integrally formed segment 52 having a bow-shaped configuration extending in the direction of the longitudinal axis 30 and in the direction 45 transverse to the axis 30. The segment 52 extends in a transverse direction 45 to a point at a crest 54 thereof. The crests 48 and 54 of the second and third terminal elements 46 and 52 respectively, establish between them the deflectable constriction 50. Integrally formed dimple-shaped protrusions 56 are provided at distal, spaced apart locations on the second terminal segment and on the third terminal segment for establishing both mechanical and electrical contact with the inner wall surface 25 of the housing member 22. The terminal member 24 is positioned in the housing member 22 and is adapted to receive and engage the plug terminal body 36 upon entrance of the body 36 into the housing through the entrance aperture 34 and to establish electrical contact between the plug body and the wall 25 of the housing body 22. Plug terminal body 36 includes a segment 27 of reduced cross section which is engaged by crests 48 and 45 to enhance gripping of the plug terminal body in the socket.

A pivot means is provided and comprises a protrusion 58 or purchase point which is integrally formed with the closure segment 26 of the housing member 22. The pivot means 58 extends from closure segment 26 and is positioned between the first terminal member segment 44 and the housing closure segment 26. This protrusion increases the deflection of the second and third terminal segments 46 and 54 thereby increasing the magnitude of the resilient force exerted between the housing inner wall 25, the second and third bow-shaped terminal segments 46 and 52, respectively, and the plug body 36 positioned in the constriction 50. FIG. 4 illustrates the plug body fully inserted into the housing member 22 and the accompanying deflection of the first terminal segment 44 in the direction of the longitudinal axis. The downward deflection as viewed in FIG. 4 further increases the magnitude of the force applied to the bow-shaped second and third terminal members 46 and 52 respectively, and thus increases and stiffens the mechanical contact force exerted between the plug member 36, the second and third terminal members 46 and 52, respectively, and the inner wall 25 of the housing member 22. In FIGS. 1–4, the protrusion 58 is located in alignment with the longitudinal axis 30 and the deflection of the segment 44 is symmetrical about this pivot or purchase point.

When the plug body 36 is withdrawn from the constriction 50 and from the member 22 and no longer contacts the terminal member 24, terminal member 24 is then unrestrained and is free for rotatable motion and can rotate about the axis 30 when actuated. This, therefore, permits the terminal member 24, upon entry of a plug body 36 of noncircular, cross-section configuration, to cause the terminal element 46 to rotate within the housing member 22 and to self-align with the plug body 36. For example, when the plug body 36 has a rectangular configuration, the terminal element 46 will be automatically rotated by the entering plug body for the most facile alignment and engagement. This occurs when parallel sides of the plug body's rectangular cross-sectional configuration align with the segments 46 and 52. After the plug body 36 is fully entered as illustrated in FIG. 4, the reactive forces imparted upon the terminal element 24 by the plug body's deflection of the bow-shaped segments operate to maintain the terminal element 24 in fixed mechanical contact with the walls and in fixed mechanical orientation with the plug body.

A means for limiting movement of the terminal member 24 in the direction of the longitudinal axis 30 and for retaining the terminal member 24 within the housing 22 is provided and comprises the integrally formed, transversely extending segment 33 of the housing member 22. As illustrated in FIGS. 1 and 4, the segment 33 is a flanged over, transversely extending segment which is circular in general configuration and which includes the entry aperture 34 formed therein. Movement of the terminal member 24 within the housing will be limited in the longitudinal direction by this segment 60.

An alternative embodiment of the invention provides for a terminal member 24 having first and second integrally formed segments. In FIGS. 5–11, those members performing functions similar to members previously described hereinbefore bear the same reference numerals. As illustrated in FIGS. 5–7, the terminal member 24 includes a first segment 44 and a second bow-shaped segment 46 having a crest 48. The deflectable constriction 50 in this case is provided between the crest 48 and a transversely extending, integrally formed segment 70 of the housing member 22. As illustrated in FIG. 5, the pivot means comprises an integral, dimple-shaped protrusion 58 extending from the first segment and which is spaced transversely from the longitudinal axis 30. A restraining dimple 59 is also provided which limits movement of the terminal member in an axial direction thereby restraining the member in the housing in the absence of a plug body.

The deflection of the first and second terminal segments 44 and 46 upon entry of the plug body 36 is illustrated in FIG. 6 wherein a plane of initial orientation of the segment 44 prior to entry of the body 36 is illustrated by the dashed line 72. This embodiment is advantageous in that it increases the surface area of electrical contact pressure and withdrawal resistance between the plug terminal body 36, the segment 46 and the inner housing wall surface 25. It will be noted from FIGS. 1–4 that the crests 48 and 54 are aligned longitudinally within the housing member 22. These crests may be offset in the direction of the longitudinal axis 30 as is exemplified by the arrangement of FIG. 5. This arrangement enables use of a terminal member having a transversely extending crest segment which can overlap, i.e., extend in the direction of the diameter of the housing 22 beyond the longitudinal axis 30. The crest 48 of segment 46 and a crest 73 of wall segment 70 overlap as best seen in FIG. 7 thus reducing the constriction spacing and enhancing mechanical gripping of the plug body 36.

Figure 9:
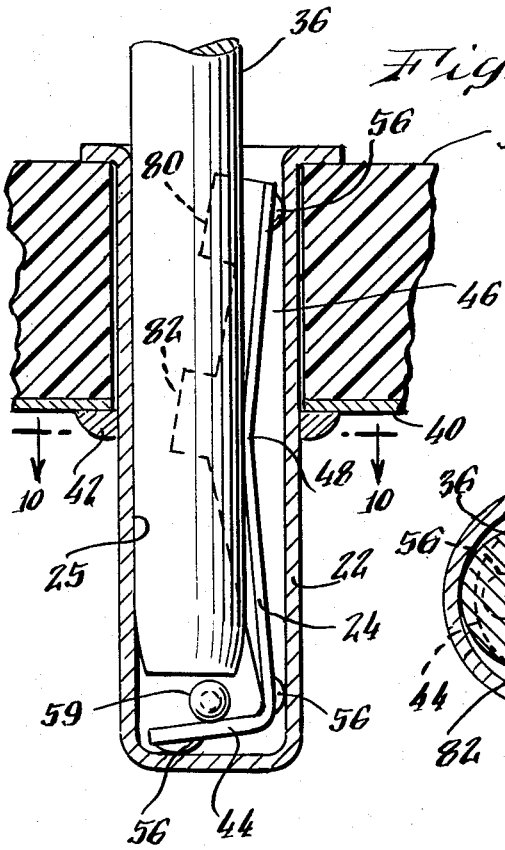
FIG. 9 is an enlarged, cross-sectional view of a socket terminal of this invention illustrating an alternative embodiment thereof.
Figure 10:
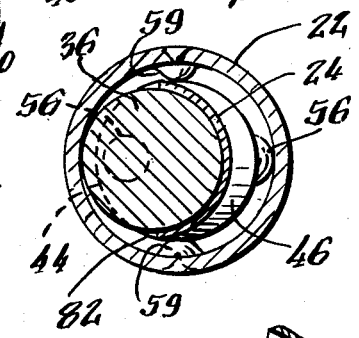
FIG. 10 is a view taken along lines 10—10 of FIG. 9.

There is illustrated in FIG. 8 an alternative arrangement of the socket arrangement of FIG. 5. In the arrangement of FIG. 8, the transversely extending housing segment 70 includes crests 76 and 78. This arrangement is advantageous in that it increases the electrical contact area and the mechanical grip and provides for partly deforming the semi-hard plug body 36 along the longitudinal axis 30 shown by segment 79 and of the plug body. In FIGS. 5 and 6, the extending segment with a single crest 73 shown therein and offset as shown deflects the plug body from the longitudinal axis. This deforms the plug body and provides enhanced gripping to prevent escape especially when subject to vibration or shock. In FIGS. 9 and 10, the terminal element 24 is shown to be comprised of the first and second segments 44 and 46, respectively, but in this case the constriction 50 is established between crest 48 and the wall surface 25 of the housing member 22. In order to maintain alignment of the plug body 36 and the terminal segment 46, the segment 46 includes pairs 80 and 82 of integrally formed arcuate-shaped segments. Only one of each pair 80 and 82 is illustrated. These segments conform with the shape of the plug body 36 and operate as guides and constraints for maintaining the plug 36 in alignment with the element 46. They also provide increased-mechanical and electrical contact therewith.

Figure 11:
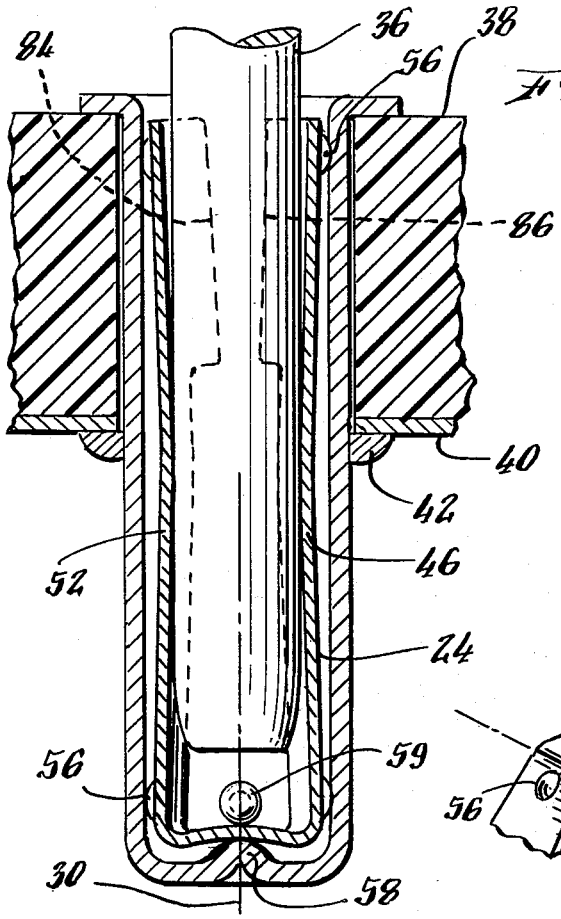
FIG. 11 is an enlarged cross-sectional view of another alternative embodiment of the socket terminal of this invention.

FIG. 11 illustrates a terminal member 24 having second and third terminal segments 46 and 52 wherein the latter segments each include pairs 84 and 86 of the arcuate-shaped segments. The segments 84 and 86 conform to the general shape of the plug body 36 and guide and maintain the plug body in alignment with the terminal member 24. They also provide additional-mechanical grip and electrical contact therewith. It is noted that in this configuration, the pivot means 58 is centrally located and aligned with the longitudinal axis 30. However it may also be offset.

Figure 12:
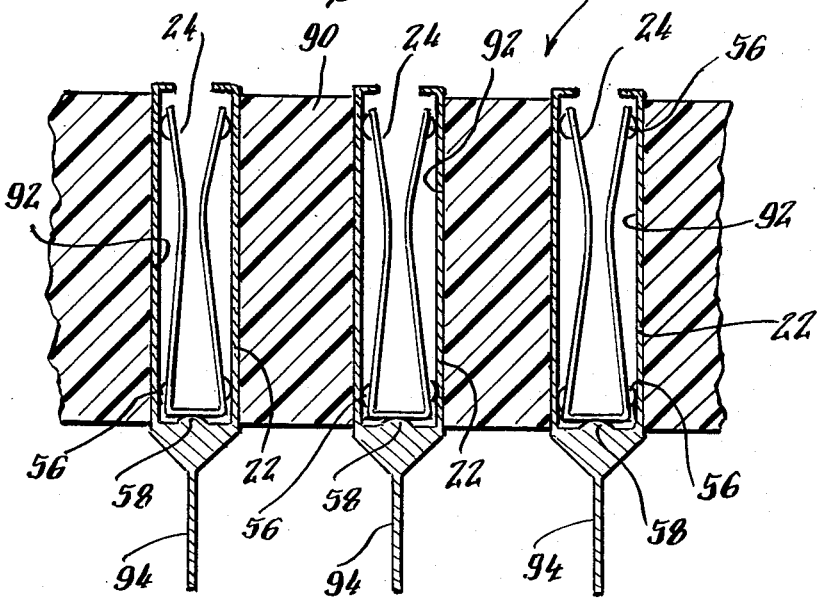
FIG. 12 is an enlarged fragmentary cross-sectional view of a connector constructed in accordance with the invention.

FIG. 12 illustrates a cross-sectional, fragmentary view of a connector in accordance with features of this invention. The connector 88 comprises a body of insulating material 90 such as molded plastic having a plurality of apertures 92 formed therein. There is positioned in each of these apertures a socket terminal of the type described hereinbefore. The dimensions of the housing member 22 and of the aperture 92 are sized for establishing a press fit therebetween. Electrical connection is provided to the housing member 22 by an electrical lead 94 which may comprise a wire wrap stud or solder terminal. This lead 94 is integrally formed with the housing member 22 or, alternatively, it may be mechanically coupled thereto by silver soldering or the like. The leads 94 are then adapted for positioning in inlets or other sockets of a receiving circuit assembly.

Figure 13:
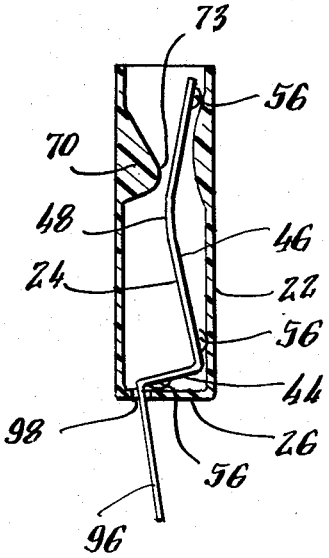
FIG. 13 is an enlarged cross-sectional view illustrating another alternative embodiment of the socket terminal of the invention.

An embodiment of the socket terminal is illustrated in FIG. 13 wherein the housing member 22 is fabricated of an insulating material. The insulating material may comprise molded plastic or may be formed of other suitable insulating materials. The terminal member 24 comprises the first segment 44 having the pivot means 56 integrally formed therewith. A second segment of the terminal member 24 comprises the bow-shaped segment 46 having a crest 48, an extending integrally formed housing segment 70 is also provided having a crest 73. A constriction is provided between the crest 73 and the crest 48 for receiving a plug terminal body as was described with respect to FIG. 5. Electrical connection is provided to the terminal member 24 by an electrical lead 96 which is integrally formed with the terminal member 24 and which lead 96 extends through an aperture 98 formed in the closure segment 26 of the housing member 22. Housing member 22 of FIG. 13 may also be formed of metal when it is desired to provide the extending terminal segment 96 for wire wrapping or other purposes.

Figure 17:
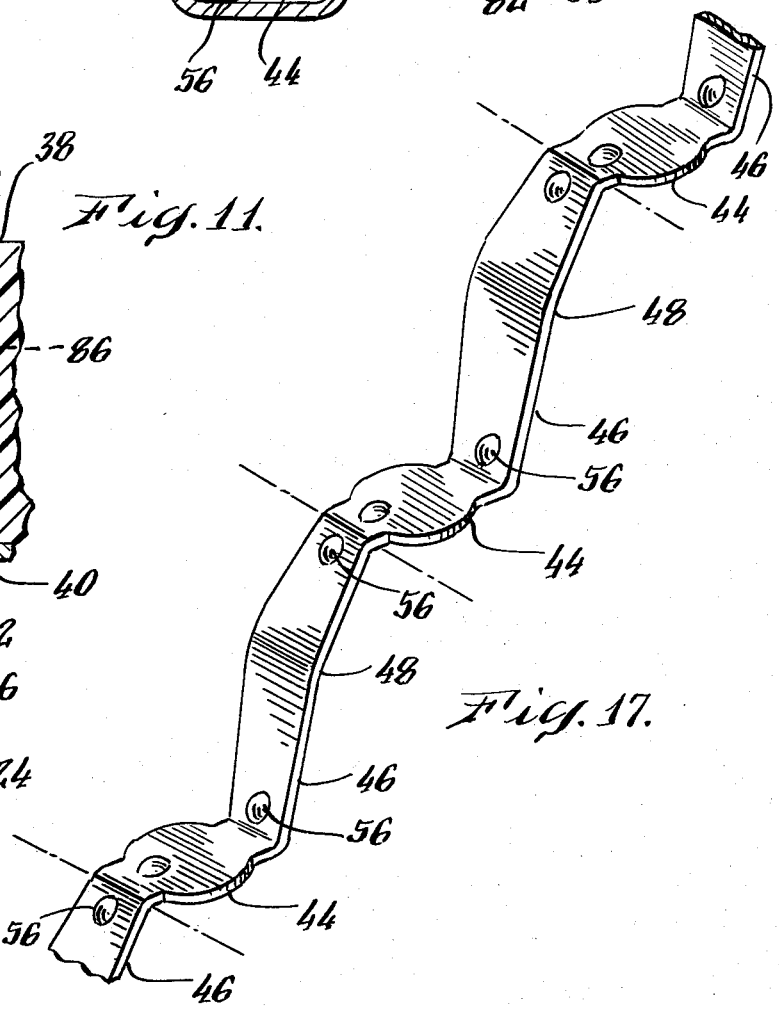
FIGS. 14–17 are views of a terminal strip during various steps of the fabrication of a terminal member; and, FIGS. 18–21 illustrates the assembly of a socket in accordance with one embodiment of the invention.
Figure 14:
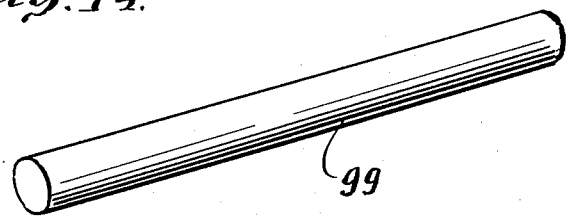
Figure 15:
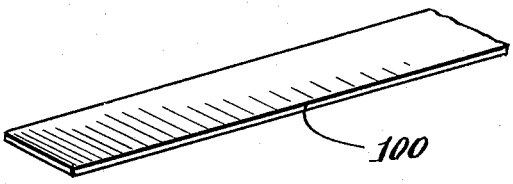
Figure 16:
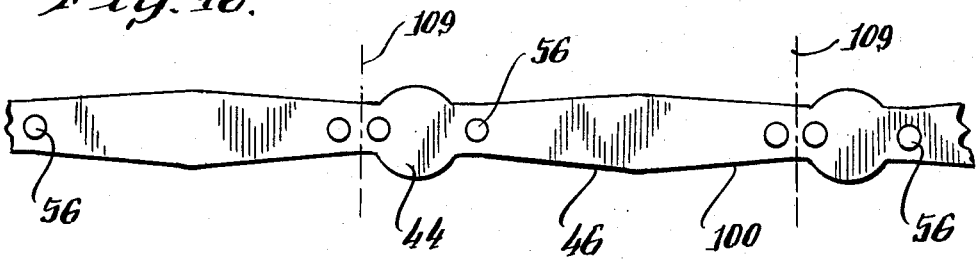

A further feature of the invention is the facility with which the terminal member 24 and the socket can be fabricated. A two segment terminal member, as illustrated in FIG. 5 for example, is fabricated by flattening beryllium copper wire (FIG. 14), for example, to a strip 100 of relatively thin rectangular, cross-sectional shape (FIG. 15). The wire of FIG. 14 is preferably a round, circular, cross-sectional configuration, but alternatively it may also have other cross-sectional configurations. Segments of the flat wire 100 are widened by coin flattening to provide terminal segments 44 and 46 as shown in FIG. 16. Dimples 56 are then formed in the strip 100 of FIG. 16. The strip 100 is subsequently formed as a continuous strip of formed terminal members, as illustrated in FIG. 17. This continuous strip of shaped terminal members is heat treated to develop a spring-temper for flexure and use. The continuous strip of shaped-formed and heat-treated terminal members is then plated with copper, gold, tin, nickel or other suitable metal. This continuous strip is formed into a roll for convenient subsequent assembly. The terminal members are subsequently cut off from the roll and placed in housing members as described hereinafter.

Figure 18:
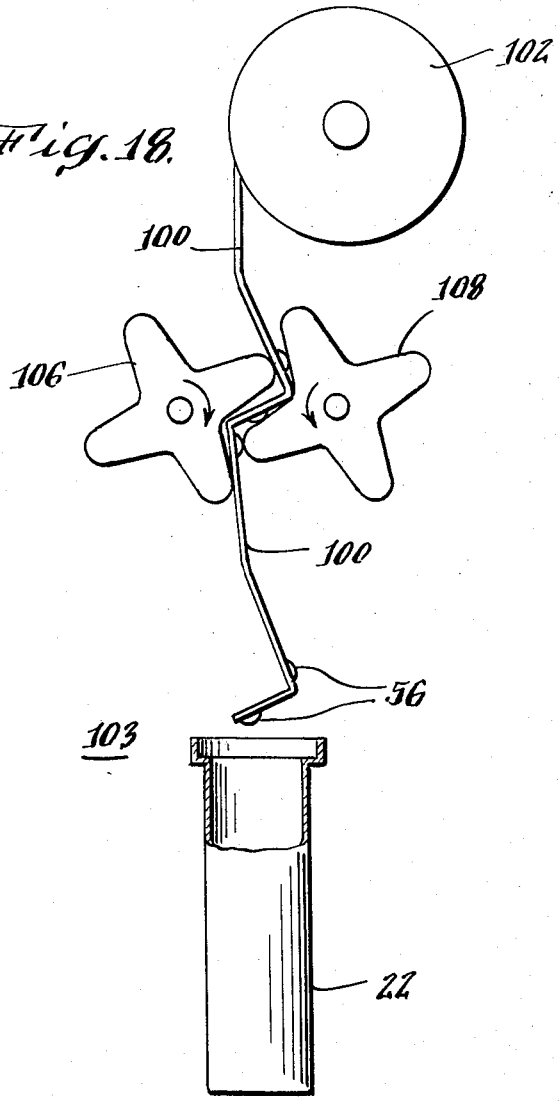
Figure 19:
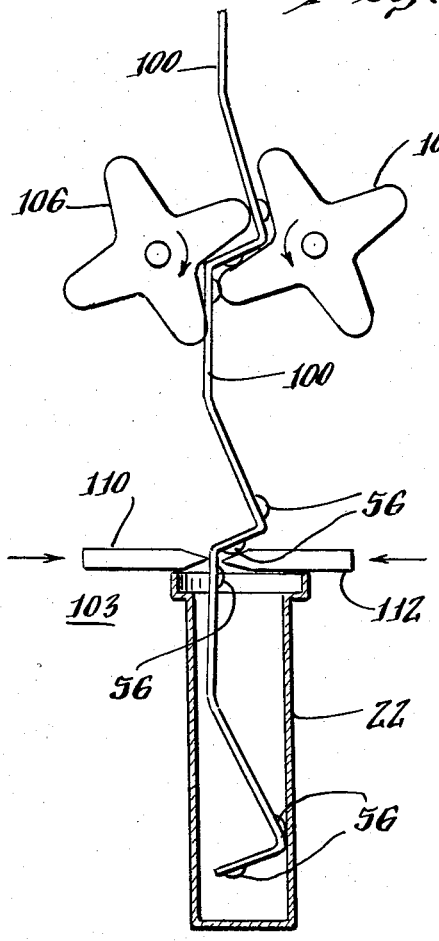

FIGS. 18 through 21 illustrate the method of assemblying the terminal members with the housing members 22 from the strip 100. A roll 102 of wound strip 100 is shown at a terminal positioning and cut off station 103, as illustrated in FIGS. 18 and 19. The strip 100 is unwound from the roll 102 and advanced by feed sprockets 106 and 108 to a preformed housing member 22.

The housing members 22 are advanced to station 103 from a supply source. The source may consist of a reservoir of such terminal housing members which are advanced from the reservoir along a track by vibratory motion, for example, until it reaches the station. At this station it is restrained by means (not illustrated for clarity) for positioning of the terminal member. Rotation of the feed sprockets 106 and 108 advances a segment of the strip 100 into the housing member 22 as illustrated in FIG. 19. Feed sprocket wheels 106 and 108 are shaped to conform to the configuration of the terminal members, provide a positive feed, and advance the terminal strip without distorting the terminal shape. After the terminal member is placed within the housing member 22, cut off knives 110 and 112 are advanced toward the strip and cut off the terminal member at cut off locations 109 (FIG. 16) from the strip thus positioning the terminal member within the housing 22. It is noted that dimples 56 formed in the strip help to self-align the strip for cutting action by knives 110 and 112. The relatively close spacing of the dimples enhances placement of the cutting knives.

Figure 20:
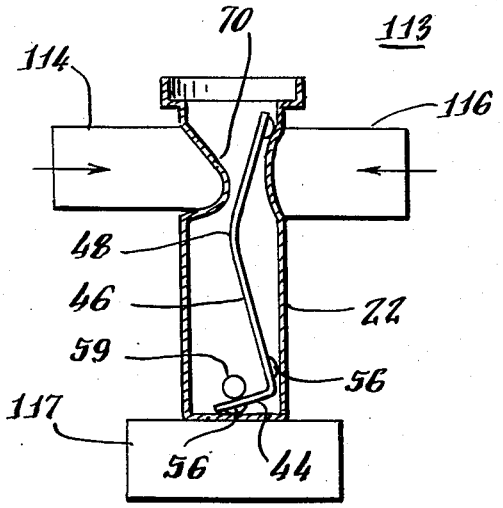
Figure 21:
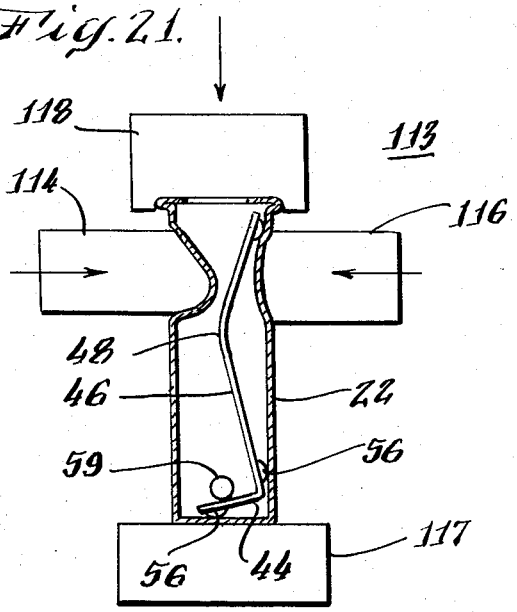

After a terminal member is positioned in the housing 22, the housing member is advanced to an indenting and crimping station 113 illustrated in FIGS. 20 and 21. At this station, the housing member 22 is formed to provide the indented segment 70 of FIG. 5 by an indenting tool 114. Back-up anvils 116 and 117 are provided for restraining the terminal member 22 during this operation. Simultaneously, restraining dimples 59 are formed by indenting tools operating generally at right angles as viewed in FIG. 21. The back-up anvils 116 and 117 and indenting tool 114 operate similarly to restrain the housing member 22 during the forming of the restraining dimples. Alternatively, indenting can be provided at station 103.

In those cases in which a flange is formed to provide an aperture in the upper portion of the housing member 22, the terminal member is crimped at station 113. A crimping tool 118 engages and crimps the upper segment of the housing to form the crimped segment 60 and the aperture 34.

There has thus been described an improved socket terminal and connector adapted for providing mechanical and electrical contact with plug terminal pins of micro-circuit components, integrated circuit components, transistors and the like. The terminal exhibits enhanced mechanical gripping of the plug posts and enhanced reliable electrical conductivity. A method has also been described wherein the socket terminal and terminal members are readily fabricated and the cost of fabricating the overall socket terminal is thereby reduced.

While there has been described particular embodiments of the invention, it will be apparent to those skilled in the art that variations may be made thereto without departing from the spirit of the invention and the scope of the appended claims.

What is claimed is:

1. An improved socket terminal comprising:

a. a housing member and a terminal member;

b. said housing member formed of an annular-shaped body having an inner wall surface a closure segment and a longitudinal axis thereof;

c. said housing body closed at one end thereof by said closure segment and having an entrance aperture at an opposite end for entrance of a plug terminal body therein;

d. said terminal member formed of a body of electrically-conductive, resilient material having first and second segments thereof;

e. said terminal member positioned in said housing body and adapted to engage a plug terminal body upon entrance thereof into said housing body and to establish contact between said plug body and said housing body;

f. said first terminal member segment extending in a direction transverse to said longitudinal axis;

g. said second terminal member segment having a bow-shaped configuration extending generally in the direction of said axis for forming a deflectable constriction through which said plug body extends and whereby the entry of said plug body deflects said second terminal segment into engagement with the inner wall of said housing;

h. said terminal member unrestrained for rotatable motion about said axis within said housing body in the absence of a male plug body, and, restrained against rotation after entry of said male plug body; and, i. pivot means positioned between said first terminal member segment and said housing closure segment for increasing deflection of said second terminal segment thereby increasing a resilient force between said housing inner wall, said second terminal segment and a plug body positioned in said housing.

2. The socket terminal of claim 1 wherein said housing member is formed of an electrically conductive material.

3. The socket terminal of claim 2 wherein said pivot means is integrally formed with said housing closure segment.

4. The socket terminal of claim 2 wherein said pivot means is integrally formed with said first terminal segment.

5. The socket terminal of claim 4 wherein said pivot means comprises a dimple-shaped protrusion.

6. The socket terminal of claim 2 wherein said pivot means comprises an extending body segment positioned between said first terminal segment and said housing closure segment and is spaced transversely from said longitudinal axis.

7. The socket terminal of claim 2 wherein said second terminal segment includes integrally formed dimple-shaped protrusions extending from said second segment for engaging the inner wall surface of said housing.

8. The socket terminal of claim 7 wherein said dimple-shaped segments are spaced apart at distal locations on said second terminal segment.

9. The socket terminal of claim 2 wherein said bow-shaped second terminal segment includes a crest and said constriction is provided between said crest and said innder housing wall.

10. The socket terminal of claim 9 wherein said housing member includes a wall segment thereof extending transversely to said axis and said constriction is formed between said wall segment and said bow-shaped second segment.

11. The socket terminal of claim 10 wherein said wall segment and said crest are longitudinally aligned.

12. The socket terminal of claim 10 wherein said wall segment and said crest are longitudinally spaced-apart.

13. The socket terminal of claim 2 wherein said terminal member includes a third segment, said third segment has a bow-shaped configuration extending generally in the direction of said axis and said third segment establishes with said second segment said deflectable constriction.

14. The socket terminal of claim 13 wherein said pivot means comprises a body positioned between said first terminal segment and said housing closure segment and is centrally located along said longitudinal axis.

15. The socket terminal of claim 2 including means for retaining said terminal member in said housing member.

16. The socket terminal of claim 15 wherein said means for retaining said terminal member comprises a housing member segment formed at said second aperture end of said housing member and extending transverse to said axis for limiting longitudinal movement of said terminal member.

17. The socket terminal of claim 2 wherein said second terminal segment conforms in part with the cross-sectional configuration of said plug terminal body.

18. The socket terminal of claim 2 including a support means, said support means having an aperture formed therein for receiving said housing member, said housing member positioned in said aperture and having a friction fit therewith, and, means for providing electrical connection between said housing member and said support means.

19. The socket terminal of claim 2 wherein said housing member is cylindrically shaped.

20. The socket terminal of claim 1 wherein said housing member is formed of an electrically insulated material and electrical contact means are provided for extending through said housing member and establishing electrical continuity with said terminal member.

21. The socket terminal of claim 20 wherein said housing member includes an aperture formed in said closure segment and said electrical contact means comprises an electrically conductive segment integrally formed with said terminal member and extending through said aperture in said closure segment.

22. The socket terminal of claim 15 wherein said means for restraining said terminal member within said housing comprises an integrally formed housing wall segment extending into said housing in a direction transverse to said longitudinal axis for engaging said first lower segment of said terminal member and restricting longitudinal movement thereof.

23. The socket terminal of claim 1 wherein said housing member includes an aperture formed therein and electrical contact means in electrical contact with said terminal member extend through said housing member aperture.

24. The socket terminal of claim 23 wherein said electrical contact means comprises an electrically conductive segment which is integrally formed with said terminal member.

25. The socket terminal of claim 24 wherein said aperture is formed in said closure segment of said housing member.

26. An improved electrical connector comprising:

a. a support body having a plurality of cylindrically shaped apertures formed therein;

b. a plurality of cylindrically shaped socket terminal housing members positioned respectively in said plurality of support body apertures;

c. said housing members formed of an electrically conductive material having a longitudinal axis thereof;

d. said housing members closed at one end thereof by a closure segment and having an entrance aperture at an opposite end for entry of a plug terminal body therein;

e. each of said housing members having a terminal member positioned therein and adapted to engage a plug terminal body upon entrance to said housing and to establish electrical contact between said plug terminal body and said housing member;

f. said terminal member formed of an electrically conductive, resilient material having first and second segments thereof;

g. said first segment extending in a direction generally transverse to said longitudinal axis;

h. said second segment having a bow-shaped configuration extending generally in the direction of said axis and establishing a deflectable constriction through which said plug terminal body extends whereby the entrance of a plug terminal body into said housing engages said second segment and deflects said second segment into engagement with an inner wall of said housing member;

i. said terminal member free to rotate about said axis in said housing in the absence of a plug body and inhibited against rotation upon the entry of a plug terminal body; and, j. means providing a pivoting engagement between said first terminal segment and said closure segment for increasing the resilient force between said housing member and said second segment.

27. The connector of claim 26 including an electrically conductive terminal lead extending from said housing member.

* * * * *